US005350015A

United States Patent [19]

Hailey

[11] Patent Number: 5,350,015

[45] Date of Patent: Sep. 27, 1994

[54] ROTARY DOWNHOLE CUTTING TOOL

[76] Inventor: Charles D. Hailey, 11628 Burning Oaks, Oklahoma City, Okla. 73150

[21] Appl. No.: 85,394

[22] Filed: Jun. 30, 1993

[51] Int. Cl.[5] ..... E21B 29/00

[52] U.S. Cl. ..... 166/55.8

[58] Field of Search ..... 166/55.8; 175/269, 267

[56] References Cited

U.S. PATENT DOCUMENTS

| | | | |
|---|---|---|---|
| 1,772,710 | 8/1930 | Denney | 166/55.8 |
| 2,859,943 | 11/1958 | Chadderdon | 166/55.8 X |
| 3,087,546 | 4/1963 | Woolley | 166/55.8 X |
| 3,295,604 | 1/1967 | Cordary et al. | 166/55.8 |
| 3,419,077 | 12/1968 | Sanford | 166/55.8 X |
| 3,684,009 | 8/1972 | Murray | 166/55.8 |
| 4,809,793 | 3/1989 | Hailey | 175/265 |
| 5,018,580 | 5/1991 | Skipper | 175/269 X |
| 5,201,817 | 4/1993 | Hailey et al. | 175/269 |
| 5,265,675 | 11/1993 | Hearn et al. | 166/297 |

FOREIGN PATENT DOCUMENTS

| | | | |
|---|---|---|---|
| 717278 | 2/1980 | U.S.S.R. | 166/55.8 |

*Primary Examiner*—Hoang C. Dang

*Attorney, Agent, or Firm*—Dougherty, Hessin, Beavers & Gilbert

[57] ABSTRACT

A downhole rotary cutting tool used with a rotational motor sub and powered by fluid pressure consisting of an elongate body housing having an axial piston cavity and plural, equi-spaced cutter blades mounted in plural equi-spaced longitudinal slots which communicate with the axial piston cavity. A piston in the piston cavity is subject to moving upward with application of fluid pressure to urge the cutter blades outboard into contact with surrounding tubular goods, and further increase of fluid pressure effects rotation of the cutting tool at relatively high speeds to cut the tubular goods.

5 Claims, 1 Drawing Sheet

ROTARY DOWNHOLE CUTTING TOOL

BACKGROUND OF THE INVENTION

1. Field of the Invention

This invention relates generally to downhole cutting tools and more particularly, but not by way of limitation, it relates to an expandable cutting tool that may be suspended via continuous tubing or the like for rapid cutting of borehole casing, drill pipe, tubing liner, etc.

2. Description of the Prior Art

There have been developed a number of different types of downhole rotary tools for scraping, cleaning and cutting tubular goods in a borehole. Tools of this general type must necessarily be of smaller diameter suitable for lowering through a relatively narrow diameter casing or tubing string to carry out cleaning and cutting operations. "Through tubing" clean-out tools as used for clean-out, cable cutting, tubing cutting and the like, have been developed and distributed by Kat Tool, Inc. of New Iberia, La.

The closest prior art may well be within the applicant's own prior development activity as characterized by U.S. Pat. No. 4,809,793, issued on Mar. 7, 1989, and a co-pending U.S. patent application which is scheduled to issue on Apr. 13, 1993 as U.S. Pat. No. 5,201,817.

SUMMARY OF THE INVENTION

The present invention relates to a still further improved down-hole cutting tool wherein plural cutter blade actuation is effected more positively to enable more rapid and accurate cutting of casing, drill pipe or the like. The tool consists of an elongated, cylindrical body member that is adapted for subassembly usage with various forms of stabilizer, rotational motor, etc. as suspended to cutting depth or position by means of such as a tubing link, either continuous or jointed. The body member includes a plurality of equi-spaced, longitudinal slots formed through the body member sidewalls and in communication with an internal axial cavity disposed within the body member. A spring loaded piston is slidably positioned within said cavity with an upper annular shoulder positioned to urge each of respective cutter members radially outward in response to applied fluid pressure urging the piston member upward thereby to continually force the cutter members outward.

Therefore, it is an object of the present invention to provide a rotary downhole cutting tool that effects positive, rapid response to effect an inside out cutting operation.

It is also an object of the present invention to provide a rotary cutting tool that utilizes relatively fewer components.

It is yet further an object of the invention to provide a downhole cutting tool that is lightweight and easily manageable at or about a drilling site.

Finally, it is an object of the present invention to provide a rotary cutting tool that is usable for operation over a range of pipe inside diameters with equal cutting capability and speed.

Other objects and advantages of the invention will be evident from the following detailed description when read in conjunction with the accompanying drawings that illustrate the invention.

DETAILED DESCRIPTION OF THE INVENTION

Figure 1:
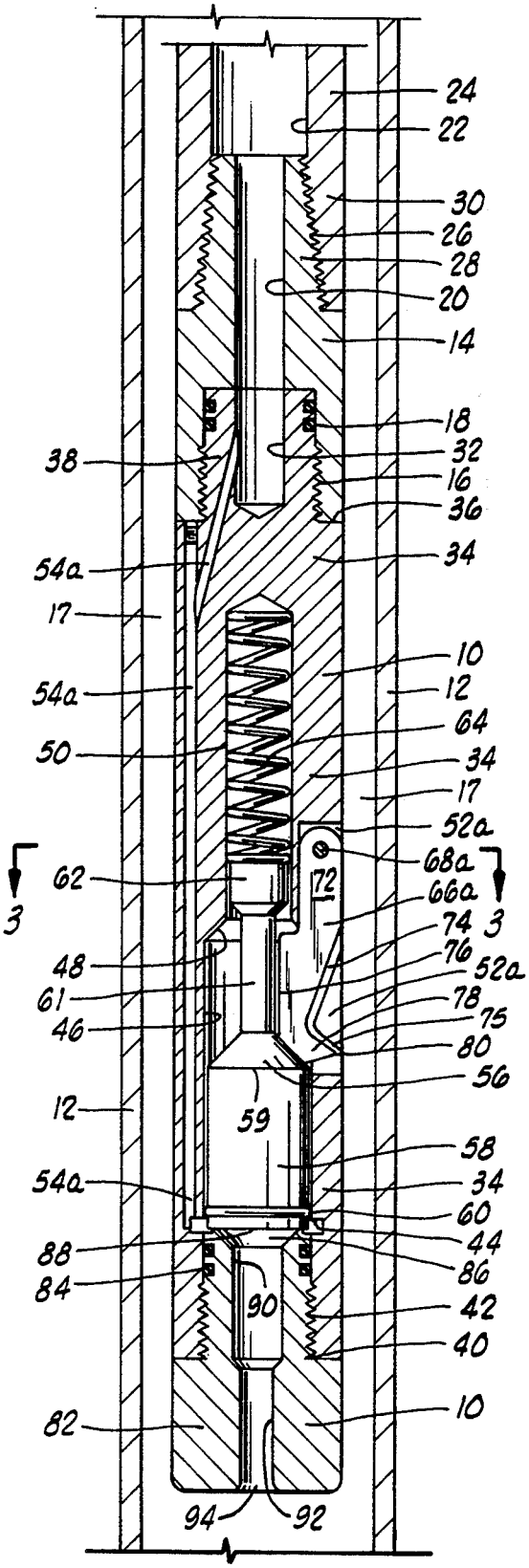
FIG. 1 is a vertical cross section of the present invention as positioned in a well bore.

FIG. 1 shows a rotary cutting tool 10 as suspended downhole in a well casing 12 preparatory to a cutting operation. The rotary cutting tool 10 is threadedly received in a connector sub 14 by means of a threaded insert 16 and sealing O-rings 18. An annulus 17 is defined adjacent the inner wall of casing 12. The connector sub 14 has an axial void 20 which communicates with an axial channel 22 of a rotary motor sub 24 joined by threaded coupling 26 which is formed between pin insert 28 and collar 30.

The rotational motor sub 24, a motor selected for small diameter drilling operation, is commercially available from SlimDril, Inc. of Houston, Tex. The small diameter SLIMDRIL" motors are capable of generating bit speeds from 740–1230 RPM for 1 11/16 outside diameter and a range of from 400–800 RPM at an outside diameter of $3\frac{3}{4}$ inches. In practice, the rotational motor sub 24 would normally be connected to a supporting member such as a continuous tubing string through which drilling fluid downflow is conducted through axial passages 22 (motor sub 24) and 20 (connector sub 14) for introduction via axial bore 32 of a tool body member 34. In the case of a jointed tubing string, the motor sub may not be required.

Figure 3:
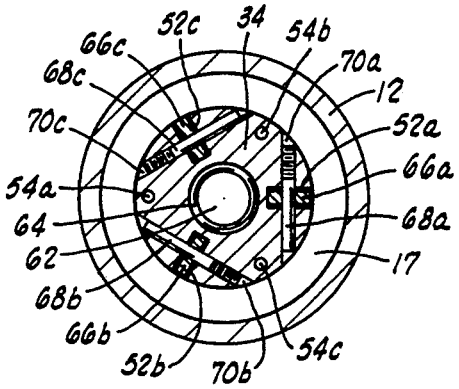
FIG. 3 is a cross-section taken on lines 3—3 of FIG. 1.
Figure 4:
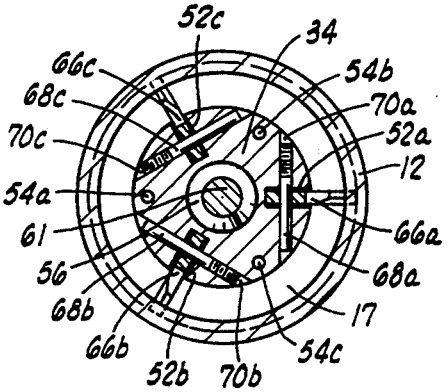
FIG. 4 is a cross-section taken on lines 4—4 of FIG. 2.

The body member 34 is formed as an elongated, cylindrical member having an upper annular shoulder 36 which is formed into the cylindrical end portion 38 having threads 16 formed thereon. The lower end of body member 34 has a cylindrical bore 40 formed axially therein with threads 42. The cylindrical bore 40 communicates with an annular channel 44 adjacent a cylinder bore 46 which terminates upwardly in a shoulder 48 and smaller diameter bore 50. A plurality of longitudinal slots 52*a, b* and *c* (see also FIG. 3) are formed in equi-spacing around body member 34, each communicating with the upper portion of cylinder bore 46. In this case, three such longitudinal slots are shown, however it could be any of several pluralities so long as the circumferal positions are in balanced relationship. Between each of the longitudinal slots 52*a, b* and *c* are formed down flowing ports 54*a, b* and *c* which communicate and direct drilling fluid between upper end cavity 32 and the lower annular cavity 44.

A reciprocal piston member 56 is unitarily formed with a piston 58 having a sealing ring 60 in contact with cylindrical wall 46, and having an annular shoulder 59 while extending a rod 61 and foot 62 into contact with a heavy compression spring 64 located within the upper cylindrical cavity 50. A cutter bar 66*a, b* and *c* is suspended in each of longitudinal slots 52*a, b* and *c* by means of respected pivot pins 68*a, b* and *c* which are threadedly secured through arc segment holes 70*a, b* and *c* in body member 34. Each of cutter bars 66*a, b* and *c* is similarly shaped and of the same thickness to have an upper pivot stem 72 extending into a lower portion having a cutting blade 74 extending through an inward angle, and a rear straight-edged camming surface 76 extending downward to form a hook-shaped foot member 78. The foot member 78 terminates outward in a point 80 that provides initial cutting contact, as will be further described. Each of the cutter bars 66*a, b* and *c* is formed of process hardened steel with selected tactile areas, such as cutting edge 74 and foot point 80, including additional hardening structure such as flush-mounted diamond pads or alternatives such as inlaid configurations of tungsten carbide surface such as KUTRITE® and/or thermally stable polycrystalline diamond materials within suitable matrices.

The lower end of body member 34 is closed over by a lower end cap 82 threadedly secured within end bore 40 by means of threads 42 as sealing rings 84 provide fluid-tight fixture. Lower end cap 82 defines an upper angular bore 86 beneath the bottom 88 of piston 58 for communication with annular groove 44 and the drilling fluid supply source. Angular bore 86 then leads down into a cylindrical counterbore 90 and still further reduced cylindrical bore 92 to bottom port 94 which releases spent drilling fluid.

In operation, after a cutting decision has been finalized, the rotary drilling tool 10 is prepared at the surface by connection of the necessary subs and the suspending tubing, either continuous or sectional. The triangular array of cutter bars 66*a, b* and *c* are positioned at their innermost disposition as shown in FIG. 1, with compression spring 64 fully extended in its uncompressed attitude, and with the piston member 58 seated in its fully downward position with piston base 88 and sealing ring 60 adjacent the annular groove 44. The rotary cutting tool 10 can then be entered down the borehole as suspended by tubing (not shown) until indication of the arrival of rotary cutting tool 10 at the proper cut position along casing 12.

Figure 2:
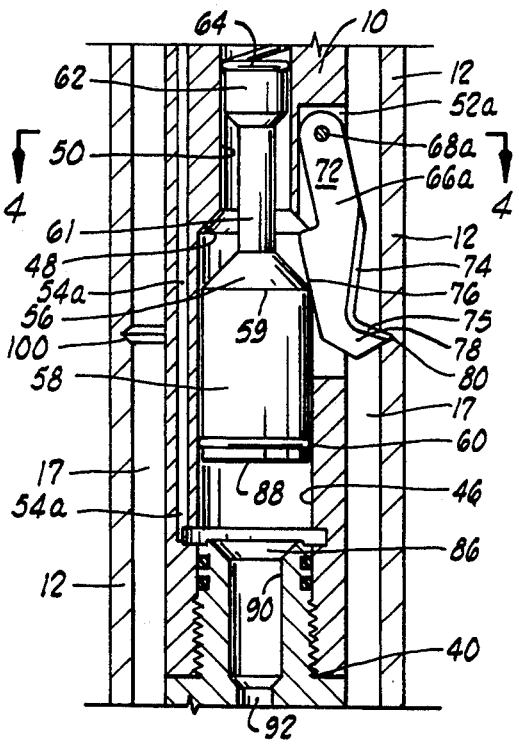
FIG. 2 is a portion of the FIG. 1 vertical section when the rotary tool is in mid-actuation.

Drilling fluid under pressure is then applied down through the tubing which causes initial rotation of the rotational motor sub 24 and rotary cutting tool 10 as drilling fluid progresses down through axial void 22 and bore 20, and through each of ports 54*a, b* and *c* to the annular groove 44 with release of drilling fluids through lower port 94. As drilling fluid pressure builds up, according to how rapidly the pressure build-up is applied from the surface source, a pressure increase within angular bore 86 and annular groove 44 forces the piston member 58 upward through the attitude as shown in FIG. 2. As this occurs, and the drilling fluid pressure at angular bore 86 approaches maximum, the annular cam shoulder 59 urges against cam edge 76 of respective cutter blades 66*a, b* and *c* to urge the cutter radially outward and into engagement with the inner wall of casing 12. As illustrated, the rotation of cutter point 80 causes formation of a cut 100 in the casing inner side wall and, in accordance with the amount of applied drilling fluid pressure and proportional rotary speeds, the cutter point 80 cuts rapidly through the casing to complete the cut. The completed cut will be indicated by a rapid pressure variation at the surface.

After noting a pressure indication of casing severance, surface fluid pressure is reduced to allow components of the rotary tool 10 to reposition to their relaxed or quiescent state, as shown in FIG. 1, whereupon the rotary cutting tool 10 may be reclaimed at the surface with commencement of subsequent well activity.

The foregoing discloses novel rotary cutting tool structure that enables rapid and accurate downhole cutting of casing, drill pipe and the like. The cutter blades effect a square casing cut with minimal surface degradation and the cuts are made in much reduced time than has heretofore been attainable.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. In a downhole cutting tool of the type that is suspended by fluid conducting continuous tubing and responsive to increased fluid pressure to effect a tubular goods cutting operation, the apparatus comprising:

an elongate body of revolution having a sidewall, upper end and lower end with the upper end connected to said tubing, said body having an axial cylinder cavity disposed adjacent the lower end and a reduced bore axially communicating downhole;

plural, equi-spaced longitudinal slots formed radially to extend outward from the cylinder cavity through the body sidewall;

plural, generally flat cutter bars pivotally suspended in each of said plural longitudinal slots, each cutter bar having a pivot hole at the upper end and extending downward to form a linear camming surface at the lower, radially inward edge, while the radially outward edge is formed as a cutter blade extending into a hook and point portion;

a piston member disposed slidably in the lower portion of the body axial cylinder cavity, said piston member having an upper camming shoulder extending upward axially to form a piston rod and foot end;

a compression spring disposed in said axial cylinder cavity and seated against said piston member end to maintain downward spring pressure;

plural porting means in said body of revolution directing fluid under pressure from the body upper end down to the body lower end for communication with said axial cylinder cavity below the piston member;

whereby sufficiently increased fluid pressure forces the piston member upward while urging the piston member upper camming shoulder against the plural cutter bar linear camming surfaces thereby to force the cutter bars outward into cutting contact with surrounding tubular goods.

2. A downhole cutting tool as set forth in claim 1 wherein said plural cutter bars each comprise:

a pivot stem having upper and lower ends and including a pivot hole at the upper end;

a linear camming surface extending from the pivot stem lower end facing radially inward;

a cutting blade extending from the pivot stem lower end facing radially outward; and a hook-shaped foot member extending from said cutting blade and camming surface, to extend radially outward to terminate in said point.

3. A downhole cutting tool as set forth in claim 1 wherein:

there are three such porting means disposed in equi-spaced circumferal location; and there are three equi-spaced longitudinal slots with cutter bars pivotally affixed therein.

4. Apparatus as set forth in claim 1 which is further characterized to include:

an annular groove formed at the lower end of the axial cylinder cavity of the body of revolution adjacent the piston member; and three of said porting means directing flow between the body upper end down for release in communication with the annular groove.

5. Apparatus as set forth in claim 1 wherein said plural cutter bars each further include:

hardening inlays positioned at primary right turn contact positions of the cutter bar.

* * * * *

UNITED STATES PATENT AND TRADEMARK OFFICE

CERTIFICATE OF CORRECTION

Patent No.: 5,350,015

Dated: September 27, 1994

Inventor(s): Charles D. Hailey

It is certified that error appears in the above-identified patent and that said Letters Patent is hereby corrected as shown below:

Column 2, line 27, delete the " (quotation marks) after "SLIMDRIL" and insert --™-- therefor;

Column 4, line 34, insert --and-- between "shoulder" and "extending"; and

Column 4, line 38, insert --foot-- between "member" and "end".

Signed and Sealed this

Twenty-second Day of November, 1994

*Attest:*

Bruce Lehman

BRUCE LEHMAN

*Attesting Officer*

*Commissioner of Patents and Trademarks*